US009317003B2

(12) United States Patent
Tsuchiya

(10) Patent No.: US 9,317,003 B2
(45) Date of Patent: Apr. 19, 2016

(54) TONER CONTAINER AND IMAGE FORMING APPARATUS INCLUDING THEREOF

(71) Applicant: KYOCERA Document Solutions Inc., Osaka-shi, Osaka (JP)

(72) Inventor: Hiroaki Tsuchiya, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/491,690

(22) Filed: Sep. 19, 2014

(65) Prior Publication Data

US 2015/0086243 A1 Mar. 26, 2015

(30) Foreign Application Priority Data

Sep. 24, 2013 (JP) ..... 2013-197348

(51) Int. Cl.
*G03G 15/08* (2006.01)
*G03G 21/18* (2006.01)
*G03G 21/16* (2006.01)

(52) U.S. Cl.
CPC ..... *G03G 21/1647* (2013.01); *G03G 15/0886* (2013.01); *G03G 21/1857* (2013.01)

(58) Field of Classification Search
CPC ..... G03G 21/1647; G03G 15/0865
USPC ..... 399/263
See application file for complete search history.

(56) References Cited

U.S. PATENT DOCUMENTS

| | | | | |
|---|---|---|---|---|
| 6,185,401 | B1 * | 2/2001 | Kanamori | G03G 15/0872 399/119 |
| 2004/0265010 | A1 * | 12/2004 | Otani | 399/258 |
| 2007/0036581 | A1 * | 2/2007 | Okabe | 399/111 |
| 2010/0067957 | A1 * | 3/2010 | Tazawa | 399/258 |
| 2010/0158575 | A1 | 6/2010 | Maeshima et al. | |
| 2012/0243914 | A1 * | 9/2012 | Yoshii et al. | 399/263 |

FOREIGN PATENT DOCUMENTS

| | | | |
|---|---|---|---|
| JP | 2005114935 | A | 4/2005 |
| JP | 2010170101 | A | 8/2010 |

* cited by examiner

*Primary Examiner* — Walter L Lindsay, Jr.
*Assistant Examiner* — Philip Marcus T Fadul
(74) *Attorney, Agent, or Firm* — Alleman Hall McCoy Russell & Tuttle LLP

(57) ABSTRACT

An apparatus main body of an image forming apparatus includes a plurality of rotation portions provided each rotatably, in alignment with each other. A lever is provided to integrally swing with one of rotation portions or one of coupling portions that is disposed at one end in alignment direction of rotation portions and coupling portions. An opening/closing mechanism is provided to open and close a toner discharge outlet, which is formed on a housing of a toner container, as the coupling portion, which is disposed at one end in the alignment direction, rotates. An interlocking mechanism, which causes adjacent coupling portions to rotate in conjunction with each other, and an interlocking mechanism, which causes adjacent rotation portions to rotate in conjunction with each other, are disposed alternately on coupling portions side and on rotation portions side, from one end to the other end in the alignment direction.

9 Claims, 19 Drawing Sheets

TONER CONTAINER AND IMAGE FORMING APPARATUS INCLUDING THEREOF

INCORPORATION BY REFERENCE

This application is based upon and claims the benefit of priority from the corresponding Japanese Patent Application No. 2013-197348 filed on Sep. 24, 2013, the entire contents of which are incorporated herein by reference.

BACKGROUND

The present disclosure relates to a toner container and an image forming apparatus including thereof.

An image forming apparatus such as a copier, a laser printer or the like includes a toner container attached to the apparatus main body. In general, the toner container includes a housing, a toner discharge outlet, and a shutter mechanism. The housing stores the toner. The toner discharge outlet is formed on the housing. The shutter mechanism is able to open and close the toner discharge outlet. Here, in the housing of the toner container, a lever, which is able to drive the shutter mechanism, may be swingably provided.

In addition, in this kind of image forming apparatus, different types of toner are used depending on, for example, specification of image quality, destination, colors of the images, or the like. Accordingly, usually, a suitable type of toner is specified for the image forming apparatus.

When the user uses a not-specified type of toner by mistake, a mechanical failure of the image forming apparatus or an image defect may occur. To prevent this, the compatibility must be eliminated from the toner containers that store the toner (hereinafter, it is also referred to as "the toner containers have the non-compatible function").

As a technology proposed for this purpose, it is known, for example, that a projection is formed on the toner container at a different position or in a different shape depending on the model of the image forming apparatus, and at the same time, a concave, with which the projection is engaged, is formed on the apparatus main body to which the toner container is attached.

However, since, in general, the projection is formed from a resin material together with the toner container main body, the projection can easily be cut off by a cutter knife or the like. As a result, there is a problem that a type of toner container, which originally cannot be attached to an image forming apparatus, can be attached to the image forming apparatus by cutting off the projection.

As a technology proposed to overcome this problem, it is known, for example, that a step portion is formed on the upper part of a toner container to extend in a direction in which the toner container is inserted into the apparatus main body, and a hollow, which communicates with inside of the toner container, is formed inside of the step portion. In that case, if the step portion is cut off, the toner is leaked from inside of the toner container. With this configuration, this technology attempts to prevent the step portion from being cut off.

SUMMARY

An image forming apparatus according to an aspect of the present disclosure includes an apparatus main body, a toner container, and a lever. The apparatus main body includes a plurality of rotation portions provided each rotatably in alignment with each other. The toner container is attached to the apparatus main body and includes a housing for storing toner, a toner discharge outlet formed on the housing, an opening/closing mechanism provided on the housing and configured to open and close the toner discharge outlet, and a plurality of coupling portions that are provided each rotatably in correspondence with the plurality of rotation portions. Each of the plurality of coupling portions is configured to, when the toner container is attached to the apparatus main body, be coupled with a corresponding one of the plurality of rotation portions to be integrally rotatable therewith. The lever is configured to integrally swing with one of the plurality of rotation portions or one of the plurality of coupling portions that is disposed at one end in an alignment direction of the plurality of rotation portions and the plurality of coupling portions. The opening/closing mechanism is configured to open and close the toner discharge outlet as the one of the plurality of coupling portions, which is disposed at one end in the alignment direction, rotates. An interlocking mechanism, which causes adjacent coupling portions to rotate in conjunction with each other, and an interlocking mechanism, which causes adjacent rotation portions to rotate in conjunction with each other, are disposed alternately on coupling portions side and on rotation portions side, from one end to the other end in the alignment direction.

A toner container according to another aspect of the present disclosure includes a housing, a toner discharge outlet, an opening/closing mechanism, and a plurality of coupling portions. The housing is attached to an apparatus main body and is configured to store toner, wherein the apparatus main body includes a plurality of rotation portions provided each rotatably, in alignment with each other. The toner discharge outlet is formed on the housing. The opening/closing mechanism is provided on the housing and is configured to open and close the toner discharge outlet. The plurality of coupling portions are provided each rotatably in correspondence with the plurality of rotation portions. Each of the plurality of coupling portions is configured to, when the toner container is attached to the apparatus main body, be coupled with a corresponding one of the plurality of rotation portions to be integrally rotatable therewith. One of the plurality of rotation portions or one of the plurality of coupling portions that is disposed at one end in an alignment direction of the plurality of rotation portions and the plurality of coupling portions includes a lever configured to integrally swing with the one of the plurality of rotation portions or the one of the plurality of coupling portions. The opening/closing mechanism is configured to open and close the toner discharge outlet as the one of the plurality of coupling portions, which is disposed at one end in the alignment direction, rotates. An interlocking mechanism, which causes adjacent coupling portions to rotate in conjunction with each other, and an interlocking mechanism, which causes adjacent rotation portions to rotate in conjunction with each other, are disposed alternately on coupling portions side and on rotation portions side, from one end to the other end in the alignment direction.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the drawings. It is noted that the present disclosure is not limited to the following embodiment.

<Image Forming Apparatus>

Figure 1:
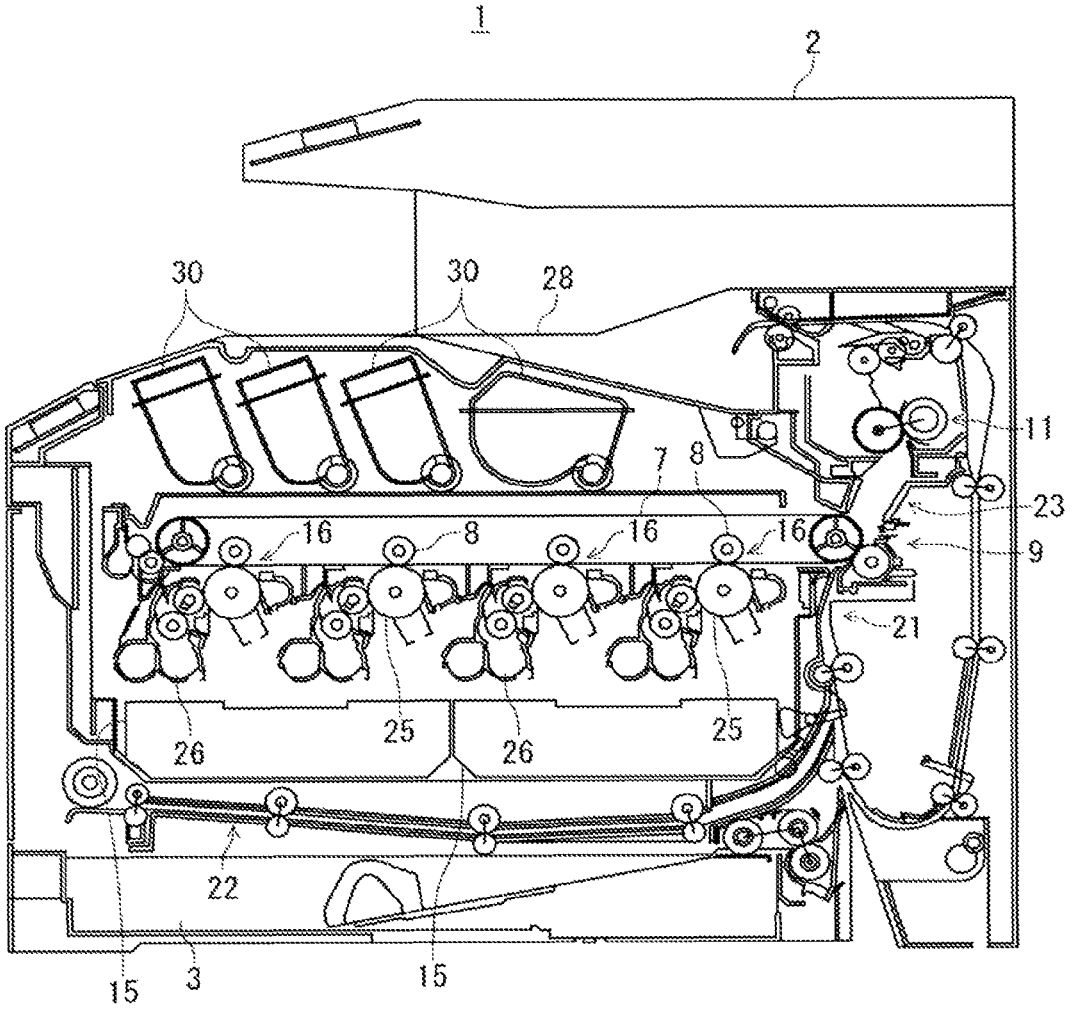
FIG. 1 is a cross-sectional view showing an outlined configuration of a laser printer as an image forming apparatus in the present embodiment.

FIG. 1 is a cross-sectional view showing an outlined configuration of an image forming apparatus 1. The image forming apparatus 1 is, for example, a tandem color printer. As shown in FIG. 1, the image forming apparatus 1 includes an apparatus main body 2 and toner containers 30 that are toner containers attached to the apparatus main body. The apparatus main body 2 includes an intermediate transfer belt 7, primary transfer portions 8, a secondary transfer portion 9, a fixing device 11, a laser scanning unit 15, and a plurality of image forming portions 16.

A sheet feed cassette 3 is disposed at an internal lower part of the apparatus main body 2 of the image forming apparatus 1. The sheet feed cassette 3 houses inside a stack of sheets (not shown) such as paper sheets before printing. On the side of the sheet feed cassette 3, there is provided a first paper sheet conveying portion 21 extending upward. The first paper sheet conveying portion 21 receives a paper sheet fed from the sheet feed cassette 3, and conveys the paper sheet to a secondary transfer portion 9 provided thereabove. Above the sheet feed cassette 3, a second paper sheet conveying portion 22 is provided to receive a paper sheet or the like fed from a manual sheet feed portion (not shown) and conveys it to the first paper sheet conveying portion 21.

The laser scanning unit 15 is disposed above the second paper sheet conveying portion 22 and emits laser light to the image forming portions 16 based on image data received by the image forming apparatus 1. For example, two laser scanning units 15, which emit laser light to two image forming portions 16, are disposed in alignment. Four image forming portions 16 are disposed above the laser scanning units 15. Above the image forming portions 16, the intermediate transfer belt 7 of an endless shape is provided. The intermediate transfer belt 7 is wound around a plurality of rollers, and is driven and rotated by a driving device not shown.

As shown in FIG. 1, the four image forming portions 16 are aligned along the intermediate transfer belt 7, and respectively form toner images of yellow, magenta, cyan, and black. Each of the image forming portions 16 includes a photoconductor drum 25 and a developing device 26, wherein the photoconductor drum 25 is a photoconductor, and the developing device 26 is disposed on the peripheral of the photoconductor drum 25. That is, in each image forming portion 16, an electrostatic latent image of a document sheet image is formed on the photoconductor drum 25 by the laser light emitted from the laser scanning unit 15, and the electrostatic latent image is developed by the developing device 26, allowing for toner images of respective colors to be formed.

The toner containers 30 are disposed above the intermediate transfer belt 7. Specifically, toner containers 30 containing toners of yellow, magenta, cyan, and black are disposed in alignment along the intermediate transfer belt 7. The toner containers 30 are configured to supply toner of the colors to the corresponding developing devices.

The primary transfer portions 8 are disposed above the respective image forming portions 16. The primary transfer portions 8 include transfer rollers for primarily transferring the toner images formed by the image forming portions 16 onto the intermediate transfer belt 7.

Toner images of respective image forming portions 16 are transferred onto the intermediate transfer belt 7 at predetermined timings while the intermediate transfer belt 7 is driven to be rotated so that toner images of four colors of yellow, magenta, cyan, and black are overlaid with each other on the surface of the intermediate transfer belt 7, thereby forming a color toner image.

The secondary transfer portion 9 is configured to transfer the toner image from the intermediate transfer belt 7 to a paper sheet by applying a transfer bias voltage of a polarity opposite to a polarity of the toner to the paper sheet conveyed from the first paper sheet conveying portion 21.

The fixing device 11 is provided above the secondary transfer portion 9. Between the fixing device 11 and the secondary transfer portion 9, there is formed a third paper sheet conveying portion 23 that conveys a paper sheet, on which a toner image has been secondarily transferred, to the fixing device 11. The fixing device 11 applies heat and pressure to the paper sheet conveyed from the third paper sheet conveying portion 23, thereby fixing the toner image on the paper sheet. The paper sheet discharged from the fixing device 11 is discharged onto a paper sheet discharge portion 28 formed above the apparatus main body 2.

Meanwhile, even in the case where the step portion is provided such that the toner container 30 has the non-compatible function, if the step portion is cut off and an opening, which is formed by cutting off the step portion, is closed by tape or the like, it is still possible to cause the toner container 30 to exert its function to supply the toner to the apparatus main body while preventing the toner from leaking. Thus, there is a problem that the toner container 30 can be used relatively easily in models of image forming apparatuses that are different from the model specified for the toner container 30. With regard to these problems, the image forming apparatus 1 can appropriately restrict use of the types of toner which are different from the type of toner suitable for the image forming apparatus 1.

<Toner Container>

FIGS. 2 through 7 show configurations of the toner containers 30 in the present embodiment.

As shown in FIGS. 1 through 4, each toner container 30 includes a housing 31, a toner discharge outlet 32, an opening/closing mechanism 33, and a lever 47. The housing 31 stores the toner, and is attached to the apparatus main body 2 of the image forming apparatus 1. The toner discharge outlet 32 is formed on the housing 31. The opening/closing mechanism 33 is provided on the housing 31 and opens and closes the toner discharge outlet 32. The lever 47 is swingably provided on the housing 31, and capable of operating the opening/closing mechanism 33.

Figure 2:
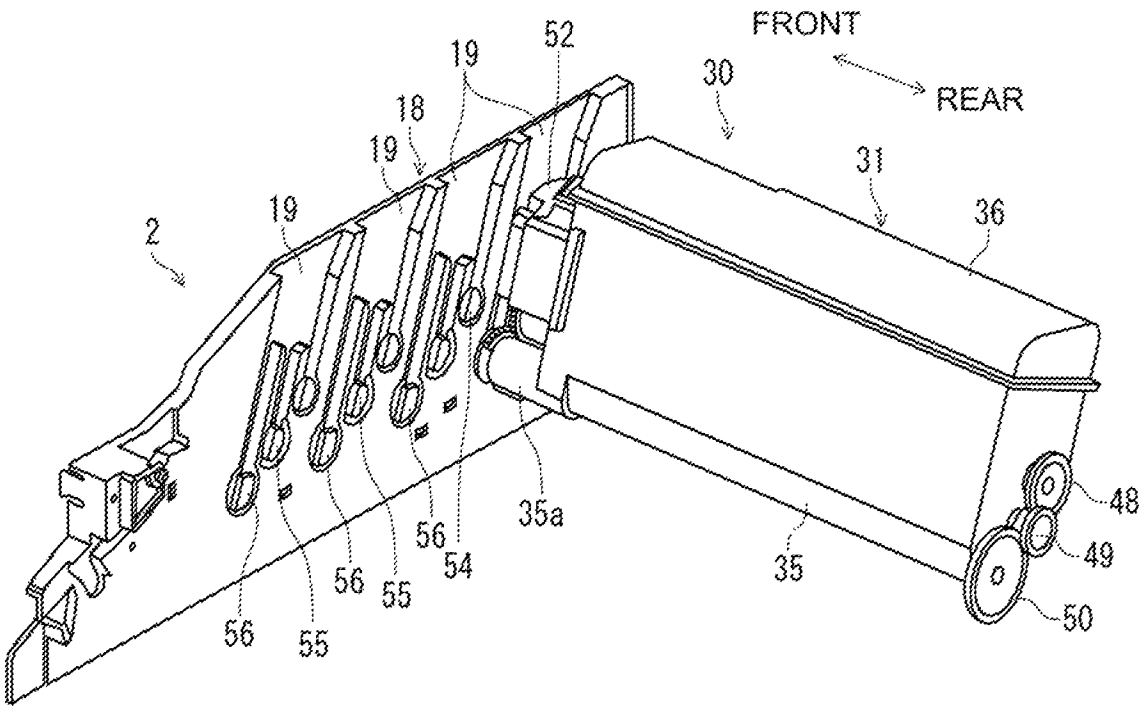
FIG. 2 is a perspective view showing a toner container together with an attachment portion.

As shown in FIG. 2, the apparatus main body 2 includes a plate-like attachment portion 18 to which the housings 31 are attached. In a surface of one side of the attachment portion 18, a plurality of container guides 19 are formed which are groove-like and extend diagonally upward. Each housing 31 is guided diagonally downward by a container guide 19 and is attached to the attachment portion 18.

The housing 31 is made of a resin material and formed in the shape of a box extending in the front-rear direction. Here, the front-rear direction is defined as a longitudinal direction of the housing 31. In addition, it is assumed that in FIG. 3, the right side is the front side and the left side is the rear side.

Figure 3:
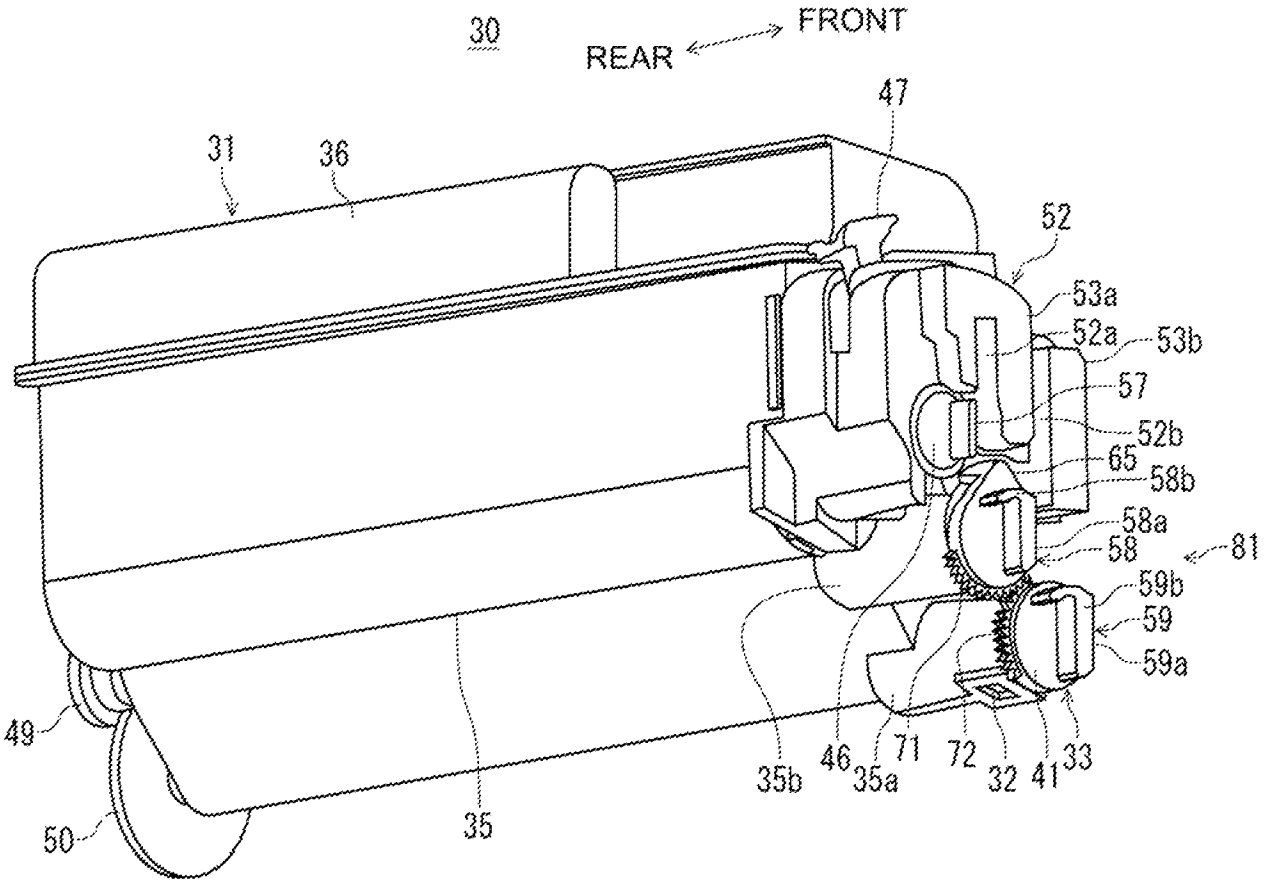
FIG. 3 is a perspective view showing an outer appearance of the toner container.
Figure 4:
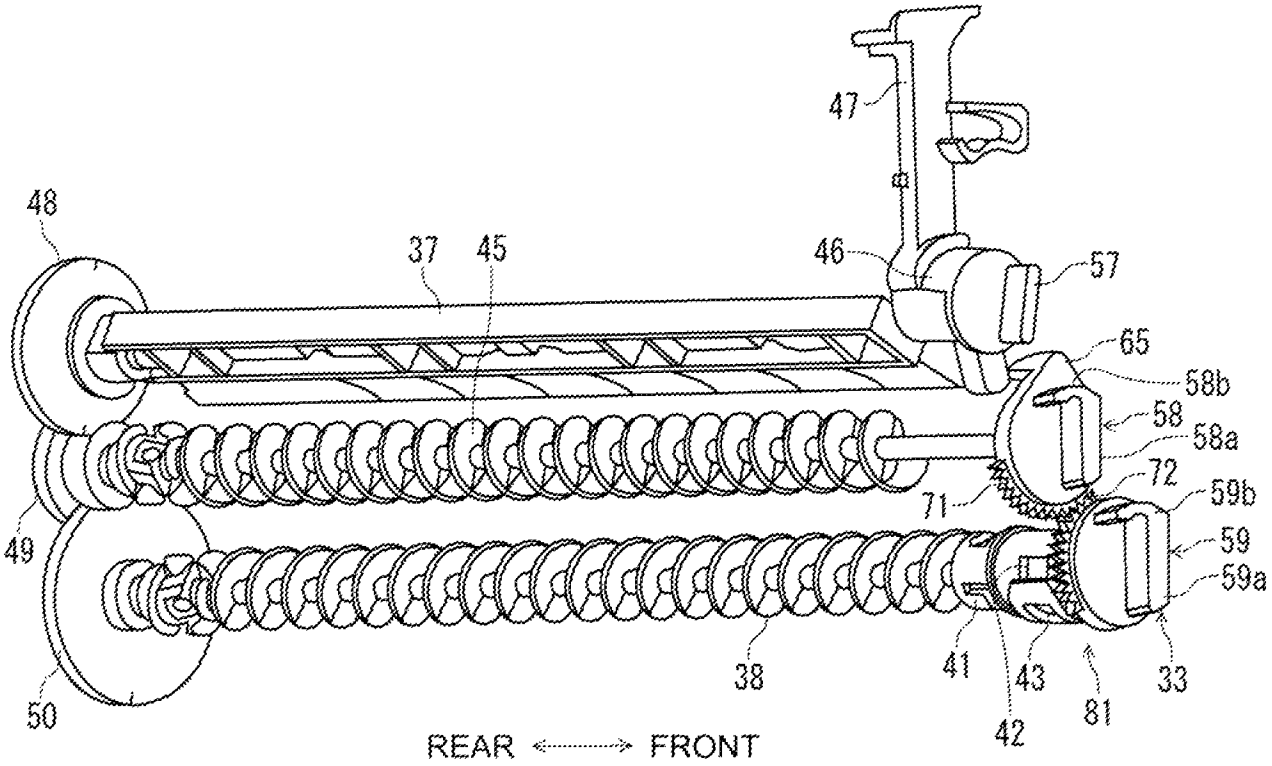
FIG. 4 is a perspective view showing an opening/closing mechanism, a stirring mechanism and a first and second screw portions.

As shown in FIG. 3, the housing 31 includes a container main body 35 and a lid 36. The upper part of the container main body 35 is opened, and the container main body 35 has a bottom. The lid 36 closes the opening part of the container main body 35. As shown in FIG. 4, a stirring paddle 37, a first screw portion 38, and a second screw portion 45 are provided inside the container main body 35. The stirring paddle 37 is configured to stir the toner. The first screw portion 38 and the second screw portion 45 are configured to convey the toner to the toner discharge outlet 32.

Figure 5:
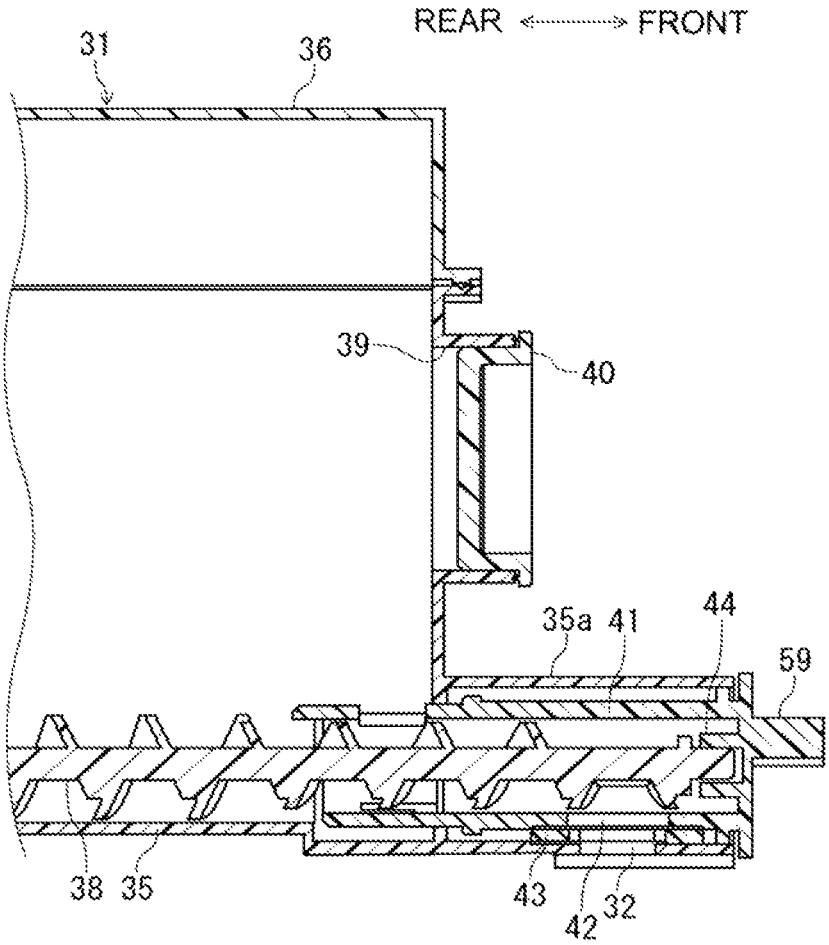
FIG. 5 is a cross-sectional view showing the configuration of the opening/closing mechanism.

As shown in FIG. 5, a toner filling opening 39 is provided on a side wall of the front part of the container main body 35. The toner filling opening 39 enables the toner to be filled into the housing 31. The toner filling opening 39 is closed by a plug 40.

As shown in FIGS. 3 and 5, the toner discharge outlet 32 is formed on the front-end side-bottom part of the container main body 35. That is, a first protruding portion 35*a* and a second protruding portion 35*b*, both approximately cylindrical and protruding in the front direction, are formed on the front-end part of the container main body 35. The toner discharge outlet 32 is formed such that it passes through a peripheral wall of the first protruding portion 35*a* downward.

As shown in FIGS. 4 and 5, the opening/closing mechanism 33 includes a shutter cylinder 41, an opening 42, and a seal member 43. The shutter cylinder 41 is inserted through the first protruding portion 35*a* of the container main body 35 and its front end is closed. The opening 42 is formed in a side surface of the shutter cylinder 41. The seal member 43 is provided at the inner wall surface of the first protruding portion 35*a* on the peripheral of the toner discharge outlet 32.

On the inner side of the front-end part of the shutter cylinder 41, a bearing 44 is formed to rotatably support the screw portion 38. The seal member 43 is able to prevent the toner from scattering.

The shutter cylinder 41 is rotatably attached to the first protruding portion 35*a*. During the rotation of the shutter cylinder 41, when the opening 42 of the shutter cylinder 41 overlaps with the toner discharge outlet 32, the toner discharge outlet 32 is opened and the toner in the housing 31 can be discharged to the developing device 26 via the toner discharge outlet 32. On the other hand, when the peripheral wall of the shutter cylinder 41, where the opening 42 is not formed, overlaps with the toner discharge outlet 32, the toner discharge outlet 32 is closed. That is, as the shutter cylinder 41 is rotated, the toner discharge outlet 32 is opened and closed.

The second protruding portion 35*b* of the container main body 35 includes a rotation plate 65 so as to close the front end of the second protruding portion 35*b* and be rotatable around a rotation axis extending in the front-rear direction. Although not shown, in the rear surface of the rotation plate 65, a bearing is formed to rotatably support the front-end part of the second screw portion 45.

Figure 7:
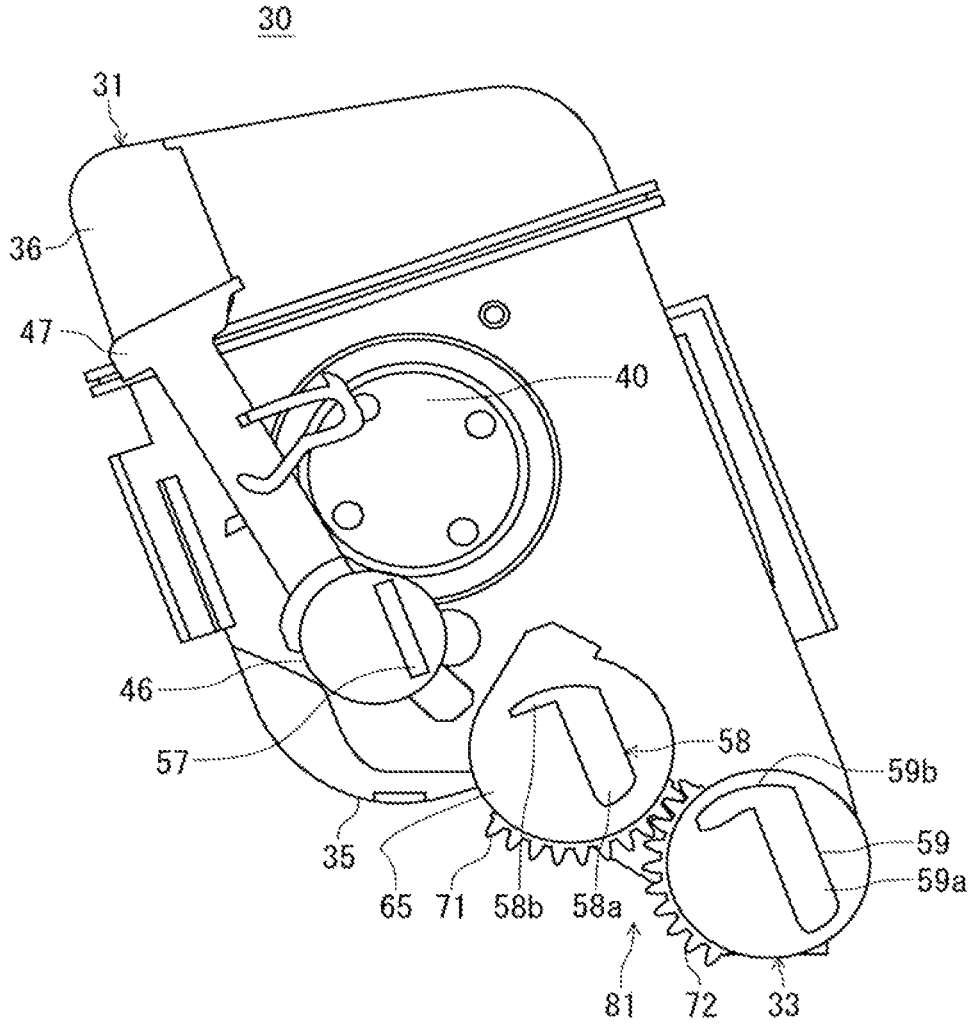
FIG. 7 is a front view showing the toner container without the cover member.

As shown in FIG. 7, the lever 47 is provided on the front-end part of the container main body 35 and includes a shaft portion 46 that is rotatably supported by the container main body 35. The shaft portion 46 has an axis that extends in the front-rear direction. The lever 47 is integrally swingable with the shaft portion 46 around the axis of the shaft portion 46.

As shown in FIG. 4, the front end of the stirring paddle 37 is rotatably supported by the inside of the shaft portion 46. On the other hand, the rear end of the stirring paddle 37 is coupled with a stirring gear 48. In addition, the rear end of the second screw portion 45 is coupled with a driving gear 49. Furthermore, the rear end of the first screw portion 38 is coupled with a driven gear 50. As shown in FIG. 2, the stirring gear 48, driving gear 49, and driven gear 50 are disposed in the rear-end part of the container main body 35.

Figure 6:
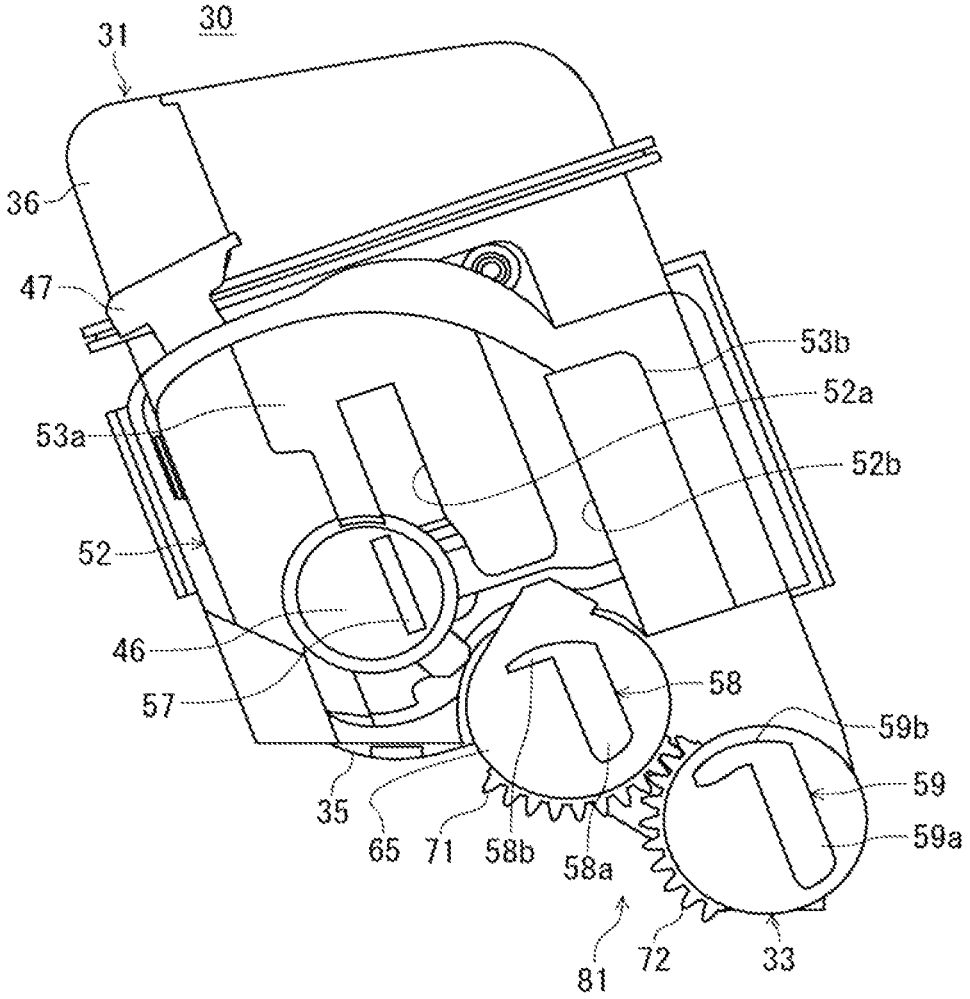
FIG. 6 is a front view showing an outer appearance of the toner container.

As shown in FIGS. 3 and 6, a cover member 52 is attached to the front-end part of the container main body 35. The cover member 52 includes a first positioning projection 53*a* and a second positioning projection 53*b* that are block-like and protrude in the front direction. The first positioning projection 53*a* has a slit 52*a* that extends in the up-down direction and is opened downward. In addition, a gap 52*b* is provided between the first positioning projection 53*a* and the second positioning projection 53*b*.

As shown in FIG. 2, when the first positioning projection 53*a* and the second positioning projection 53*b* are fitted in the container guide 19 and guided by the container guide 19 diagonally downward, the housing 31 is attached to the attachment portion 18.

Figure 8:
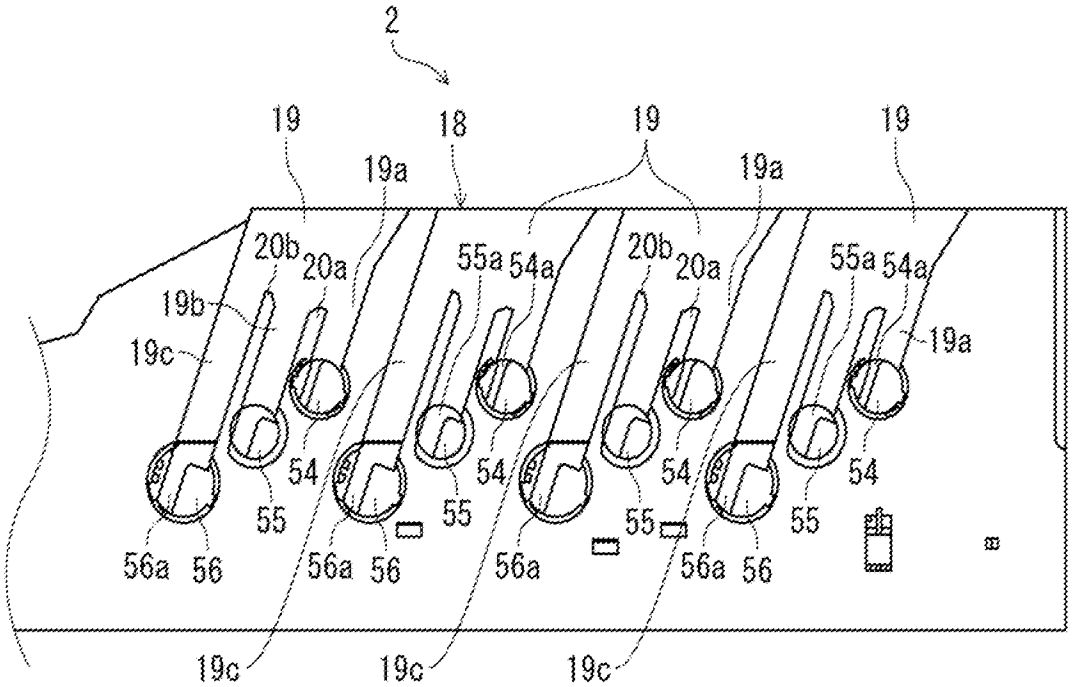
FIG. 8 is a rear view showing an outer appearance of the attachment portion.
Figure 9:
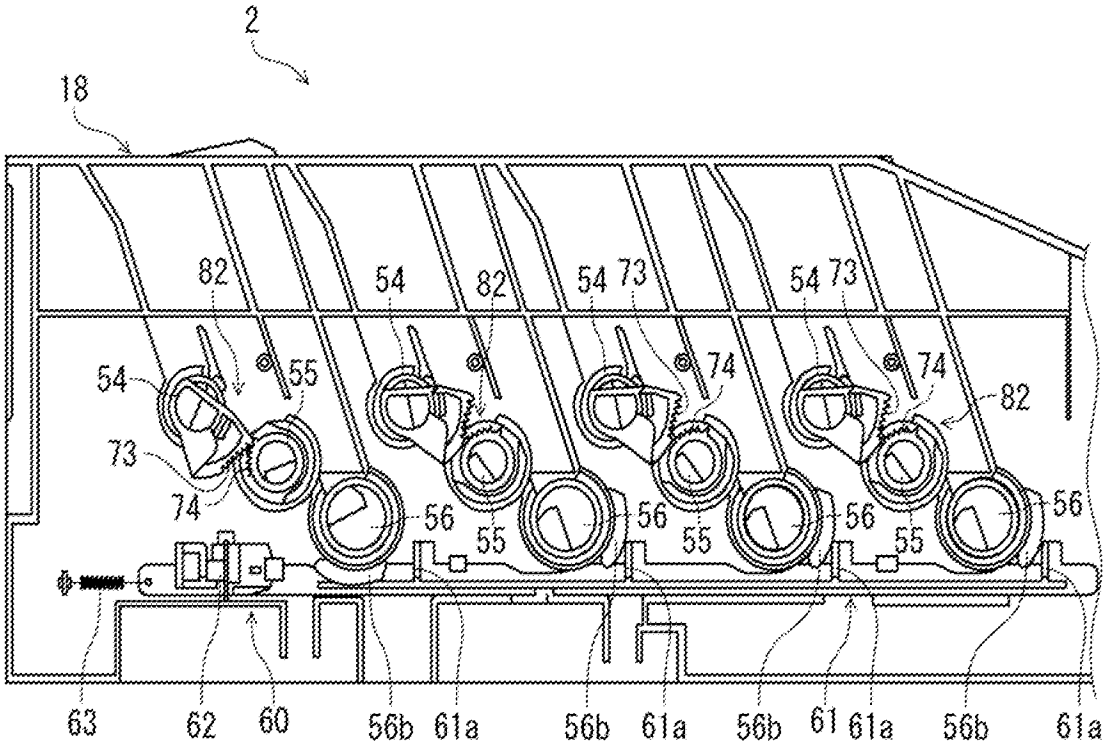
FIG. 9 is a front view showing the attachment portion to which a container has been attached.
Figure 10:
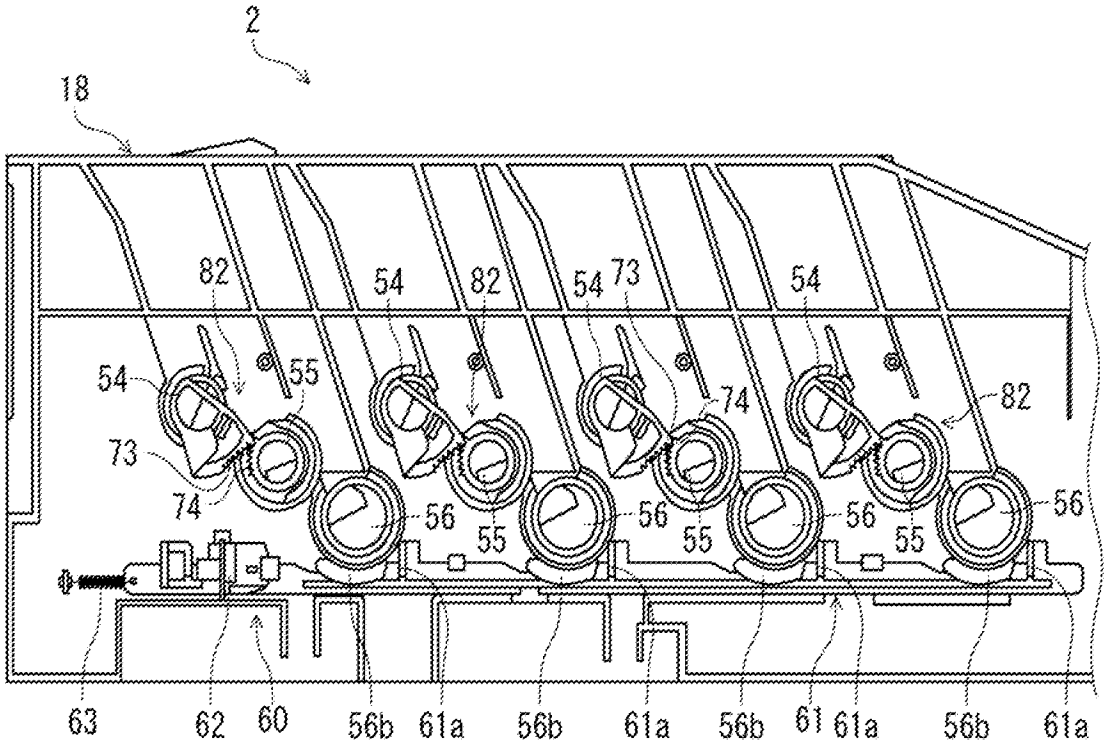
FIG. 10 is a front view showing the attachment portion to which four containers have been attached.
Figure 11:
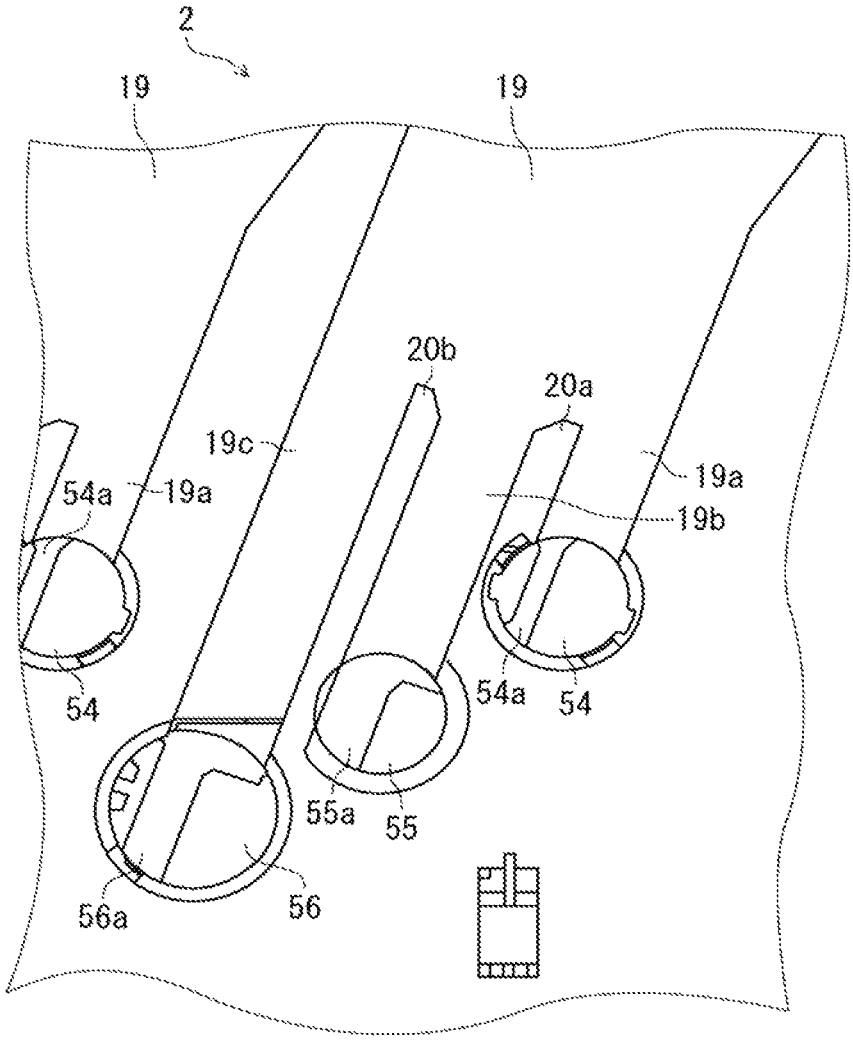
FIG. 11 is a rear view showing an enlargement of the first rotation portion and the second rotation portion.
Figure 12:
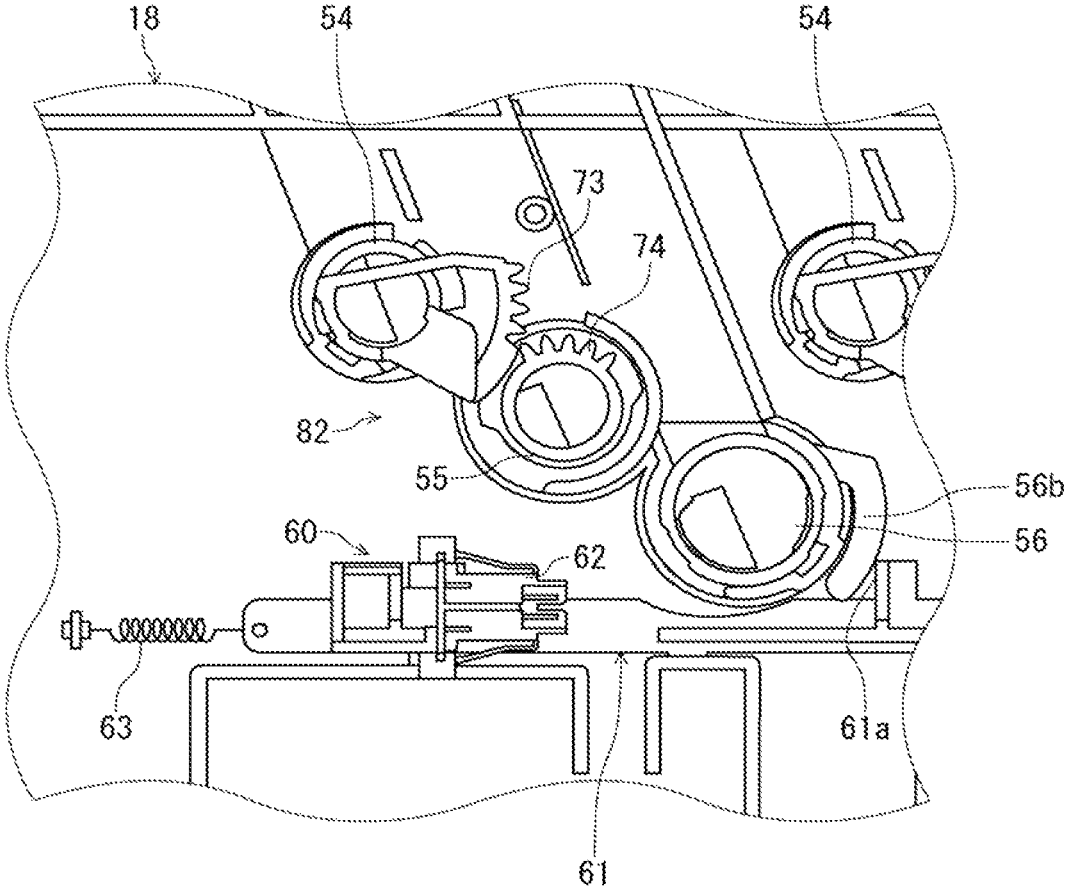
FIG. 12 is a front view showing an enlargement of the first rotation portion and the second rotation portion.
Figure 13:
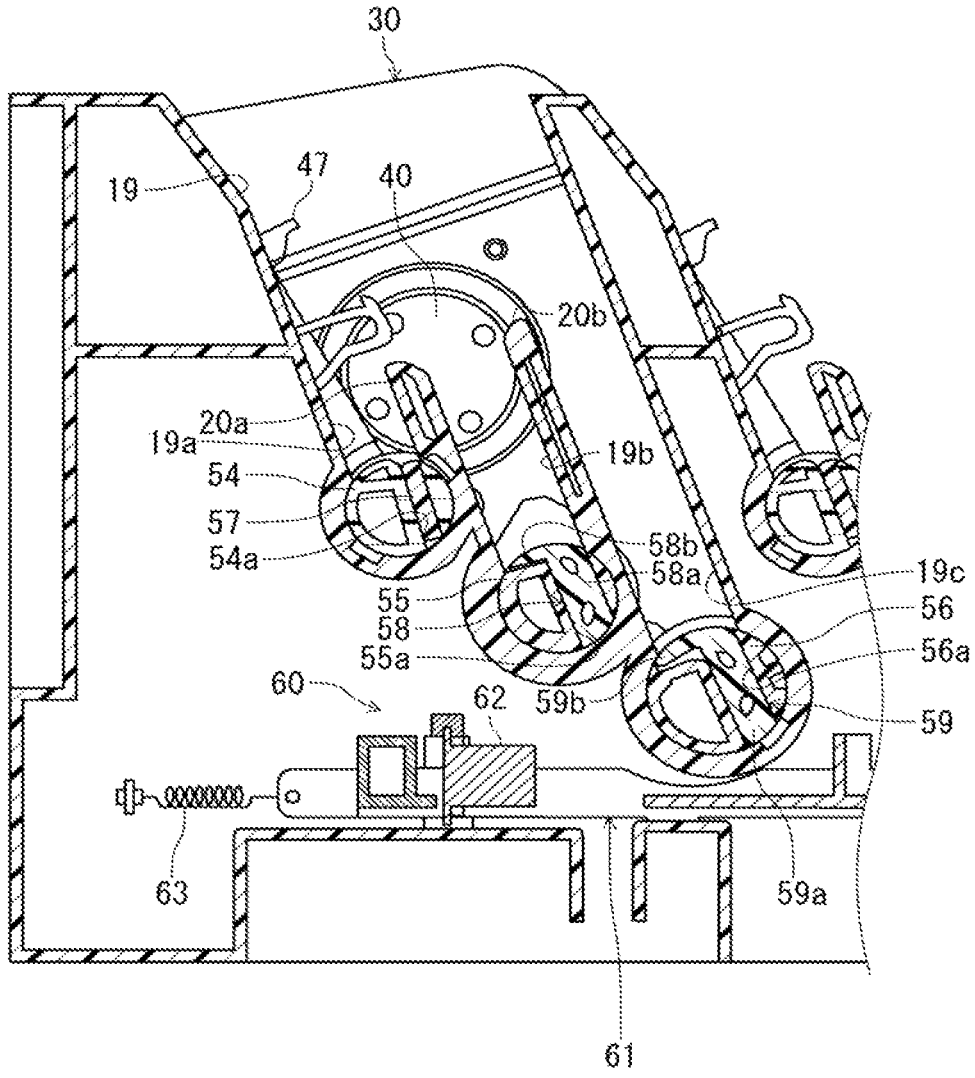
FIG. 13 is a partially broken front view showing a toner container attached to the attachment portion.

FIGS. 8 through 10 show outer appearances of the attachment portion 18. FIGS. 11 and 12 show enlargements of a first rotation portion 54, a second rotation portion 55, and a third rotation portion 56. FIG. 13 shows a toner container 30 attached to the attachment portion 18.

As shown in FIGS. 8 and 11, in the attachment portion 18, the lower portion of the container guide 19 is branched into three portions: a first groove portion 19*a*; a second groove portion 19*b*; and a third groove portion 19*c*, so that the cover member 52 is attached thereto. Between the first groove portion 19*a* and the second groove portion 19*b*, a first projection strip 20*a* is formed to extend along the first groove portion 19*a* and the second groove portion 19*b*. Between the second groove portion 19*b* and the third groove portion 19*c*, a second projection strip 20*b* is formed to extend along the second groove portion 19*b* and the third groove portion 19*c*.

When the cover member 52 is guided by the container guide 19 diagonally downward to the attachment position, the first projection strip 20*a* is inserted into a slit 52*a* of the cover member 52, and the second projection strip 20*b* is inserted into a slit 52*b* of the cover member 52.

As shown in FIGS. 8 through 12, the first rotation portion 54, the second rotation portion 55, and the third rotation portion 56 are provided, each rotatably, in alignment with each other in the attachment portion 18. The first rotation portion 54, the second rotation portion 55, and the third rotation portion 56 are aligned in order from the upper-right side (one end side) to the lower-left side (the other end side) in FIG. 8. The attachment portion 18 includes four sets of first rotation portion 54, second rotation portion 55, and third rotation portion 56 in correspondence with the four toner containers 30, respectively.

The first rotation portion 54 is disposed at the lower end of the first groove portion 19*a* of each container guide 19 and is supported rotatably by the attachment portion 18. The second rotation portion 55 is disposed at the lower end of the second groove portion 19*b* and is supported rotatably by the attachment portion 18. The third rotation portion 56 is disposed at the lower end of the third groove portion 19*c* and is supported rotatably by the attachment portion 18.

On the other hand, as shown in FIGS. 7 and 13, each toner container 30 includes a first coupling portion 57, a second coupling portion 58, and a third coupling portion 59 that are rotatably provided in correspondence with the first rotation portion 54, second rotation portion 55, and third rotation portion 56.

When the toner container 30 is attached to the apparatus main body 2, the first coupling portion 57, second coupling portion 58, and third coupling portion 59 are coupled with the first rotation portion 54, the second rotation portion 55, and the third rotation portion 56 to be integrally rotatable therewith, respectively. That is, when the toner container 30 is attached to the apparatus main body 2, the first coupling portion 57 is coupled with the first rotation portion 54 to be integrally rotatable therewith. In addition, when the toner container 30 is attached to the apparatus main body 2, the second coupling portion 58 is coupled with the second rotation portion 55 to be integrally rotatable therewith. Furthermore, when the toner container 30 is attached to the apparatus main body 2, the third coupling portion 59 is coupled with the third rotation portion 56 to be integrally rotatable therewith.

The lever 47 is configured to be integrally swingable with the first coupling portion 57 that is disposed at one end (i.e., the upper-left part in FIG. 6) in an alignment direction of the first coupling portion 57, second coupling portion 58, and third coupling portion 59 (in other words, an alignment direction of the first rotation portion 54, second rotation portion 55, and third rotation portion 56. Hereinafter, the direction is merely referred to as "alignment direction").

That is, the first coupling portion 57 is formed integrally with the front end of the shaft portion 46 of the lever 47 and formed in the shape of a plate protruding in the front direction. In addition, the first coupling portion 57 extends linearly in the attachment direction in which, when the housing 31 is attached to the attachment portion 18, the cover member 52 is guided by the container guide 19 (i.e., extends diagonally downward).

As shown in FIG. 11, the first rotation portion 54 of the apparatus main body 2 has a first coupling groove 54*a* with which the first coupling portion 57 is coupled. The first coupling groove 54*a* extends linearly at least in part. On the other hand, the first coupling portion 57 is shaped such that it is fitted in the first coupling groove 54*a*. That is, the groove width of the first coupling groove 54*a* is approximately the same as the plate thickness of the first coupling portion 57. Upon insertion into the first coupling groove 54*a*, the first coupling portion 57 is coupled with the first rotation portion 54.

The second coupling portion 58 is formed integrally with the rotation plate 65 of the toner container 30. The second coupling portion 58 is formed in the shape of a hook in a cross section perpendicular to the axis direction of the rotation plate 65.

Specifically, the second coupling portion 58 includes a first portion 58*a* and a second portion 58*b*. The first portion 58*a* extends linearly in the attachment direction in which, when the housing 31 is attached to the attachment portion 18, the cover member 52 is guided by the container guide 19 (i.e., extends diagonally downward). The second portion 58*b* extends from the upper end part of the first portion 58*a* in one of the rotational directions of the shutter cylinder 41. The first portion 58*a* is greater than the first coupling portion 57 in plate thickness.

As shown in FIG. 11, the second rotation portion 55 of the apparatus main body 2 has a second coupling groove 55*a* formed to be coupled with the second coupling portion 58. The second coupling groove 55*a* extends linearly at least in part. On the other hand, the second coupling portion 58 is shaped such that it is fitted in the second coupling groove 55*a*. That is, the groove width of the second coupling groove 55*a* is approximately the same as the plate thickness of the first portion 58*a* of the second coupling portion 58. As a result, the second coupling groove 55*a* is different from the first coupling groove 54*a* in groove width. Upon insertion into the second coupling groove 55*a*, the second coupling portion 58 is coupled with the second rotation portion 55.

The third coupling portion 59 is formed integrally with the front end of the shutter cylinder 41 and protrudes in the front direction. The third coupling portion 59 is configured to be integrally rotatable with the shutter cylinder 41. The third coupling portion 59 is formed in the shape of a hook in a cross section perpendicular to the axis direction of the shutter cylinder 41.

Specifically, the third coupling portion 59 includes a first portion 59*a* and a second portion 59*b*. The first portion 59*a* extends linearly in the attachment direction in which, when the housing 31 is attached to the attachment portion 18, the cover member 52 is guided by the container guide 19 (i.e., extends diagonally downward). The second portion 59*b* extends from the upper end part of the first portion 59*a* in one of the rotational directions of the shutter cylinder 41. The first portion 59*a* is greater than the first coupling portion 57 in plate thickness.

As shown in FIG. 11, the third rotation portion 56 of the apparatus main body 2 has a third coupling groove 56*a* formed to be coupled with the third coupling portion 59. The third coupling groove 56*a* extends linearly at least in part. On the other hand, the third coupling portion 59 is shaped such that it is fitted in the third coupling groove 56*a*. That is, the groove width of the third coupling groove 56*a* is approximately the same as the plate thickness of the first portion 58*a* of the third coupling portion 59. As a result, the third coupling groove 56*a* is different from the first coupling groove 54*a* in groove width.

Upon insertion into the third coupling groove 56*a*, the third coupling portion 59 is coupled with the third rotation portion 56. The opening/closing mechanism 33 is configured to open and close the toner discharge outlet 32 as the third coupling portion 59 rotates.

As shown in FIG. 12, each third rotation portion 56 includes an arm 56*b* provided on a side of the attachment portion 18 opposite to the side on which the container guides 19 are formed. The arm 56*b* is formed integrally with the third rotation portion 56 to extend in one of the rotational directions of the third rotation portion 56. The arm 56*b* has an outer circumferential side surface that is in a circular arc shape.

The first coupling portion 57, second coupling portion 58, and third coupling portion 59 are configured in the non-compatible shape which is a shape that allows for attachment of the housing 31 to the apparatus main body 2 of a predetermined model, while not allowing for attachment of the housing 31 to the apparatus main body 2 of the other models. For example, depending on the model or the like of the image forming apparatus 1, the first coupling portion 57, second coupling portion 58, and third coupling portion 59, and the first coupling groove 54*a*, second coupling groove 55*a*, and third coupling groove 56*a* of the first rotation portion 54, second rotation portion 55, and third rotation portion 56 are provided at different positions, in different shapes, or the like.

In addition, the second coupling portion 58 and the third coupling portion 59, which are adjacent to each other, are configured to rotate in conjunction with each other by a first gear 71 and a second gear 72 that are provided as the interlocking mechanism. That is, as shown in FIG. 7, each toner container 30 includes: a first gear 71 that integrally rotates with the second coupling portion 58; and a second gear 72 that meshes with the first gear 71 and integrally rotates with the third coupling portion 59.

The first gear 71 is integrally formed with the rotation plate 65, and the second gear 72 is integrally formed with the shutter cylinder 41. The third coupling portion 59 is configured to rotate in a direction that is opposite to the rotational direction of the second coupling portion 58.

In addition, the first rotation portion 54 and the second rotation portion 55, which are adjacent to each other, are configured to be rotated in conjunction with each other by a third gear 73 and a fourth gear 74 that are provided as the interlocking mechanism. That is, as shown in FIG. 12, the attachment portion 18 includes: a third gear 73 that integrally rotates with the first rotation portion 54; and a fourth gear 74 that meshes with the third gear 73 and integrally rotates with the second rotation portion 55.

The third gear 73 is integrally formed with the first rotation portion 54, and the fourth gear 74 is integrally formed with the second rotation portion 55. The second rotation portion 55 is configured to rotate in a direction that is opposite to the rotational direction of the first rotation portion 54.

In this way, in the image forming apparatus 1, the interlocking mechanism, which causes the second coupling portion 58 and the third coupling portion 59 adjacent to each other to rotate in conjunction with each other, and the interlocking mechanism, which causes the first rotation portion 54 and the second rotation portion 55 adjacent to each other to rotate in conjunction with each other, are disposed alternately on the coupling portions 57, 58, 59 side and on the rotation portions 54, 55, 56 side, from one end to the other end in the alignment direction. This causes the driving force applied to the lever 47 to be transmitted alternately (meanderingly) between the apparatus main body 2 and the toner container 30 from one end to the other end in the alignment direction.

As shown in FIGS. 9 and 10, a detection mechanism 60 is provided on the attachment portion 18. The detection mechanism 60 detects that the toner discharge outlets 32 of the toner containers 30 attached to the apparatus main body 2 are in the open state. The detection mechanism 60 of the present embodiment detects that all of the toner discharge outlets 32 of the plurality of toner containers 30 attached to the attachment portion 18 are in the open state by detecting that all of the second rotation portions 55 were rotated.

The detection mechanism 60 includes the third rotation portion 56, a detection bar 61, and a sensor 62. The detection bar 61 extends along the surface of the attachment portion 18 in the alignment direction of the third rotation portions 56. The sensor 62 is provided at one end of the detection bar 61 and is able to detect that the third rotation portion 56 rotated. The other end of the detection bar 61 is connected to a tension spring 63.

Figure 19:
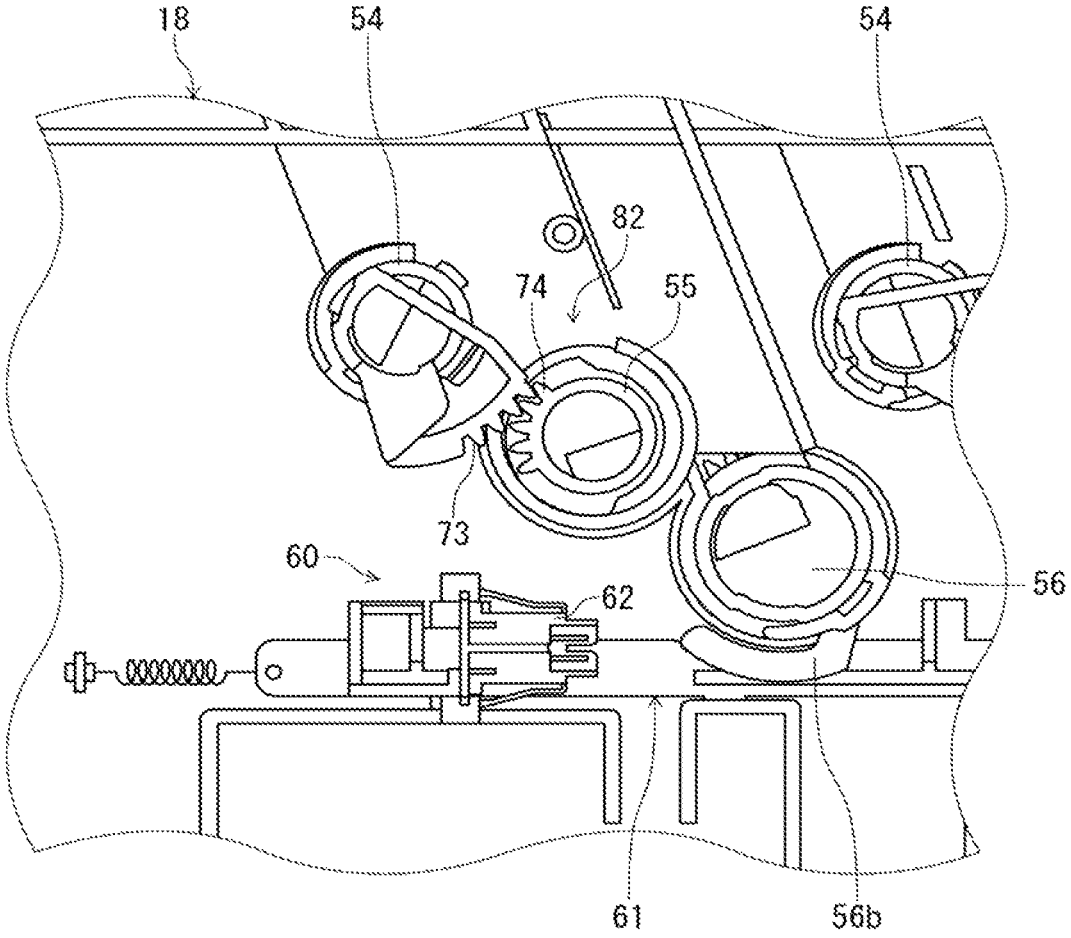
FIG. 19 is a front view showing the first through third rotation portions with the lever swung.

The detection bar 61 includes locking portions 61*a* that are respectively locked to the arms 56*b* of the third rotation portion 56. Four locking portions 61*a* are provided in correspondence with the four arms 56*b*. As shown in FIG. 12, when the toner discharge outlet 32 is closed, the locking portions 61*a* are locked to the arms 56*b*, thereby restricting the detection bar 61 from moving toward the tension spring 63 (the left side in FIG. 12). On the other hand, as shown in FIG. 19, when the toner discharge outlet 32 is opened, the second rotation portions 55 are rotated anticlockwise and the locking portions 61*a* are not locked to the circular-arc outer circumferential side surfaces of the arms 56*b*.

As shown in FIG. 10, when all of the toner discharge outlets 32 are opened, all of the locking portions 61*a* are not locked to the outer circumferential side surfaces of the arms 56*b*, and the detection bar 61 is pulled by the tension spring 63 in the direction to move away from the sensor 62 (leftward in FIG. 10).

When the detection bar 61 is close to the sensor 62 as shown in FIG. 9, the sensor 62 detects the ON state where at least one toner discharge outlet 32 is closed. On the other hand, when the detection bar 61 has moved away from the sensor 62 as shown in FIG. 10, the sensor 62 detects the OFF state where all of the toner discharge outlets 32 are opened. In this way, the detection mechanism 60 detects, based on the detection result of the sensor 62, that the toner discharge outlets 32 of the toner containers 30 attached to the apparatus main body 2 are in the open state.

Figure 14:
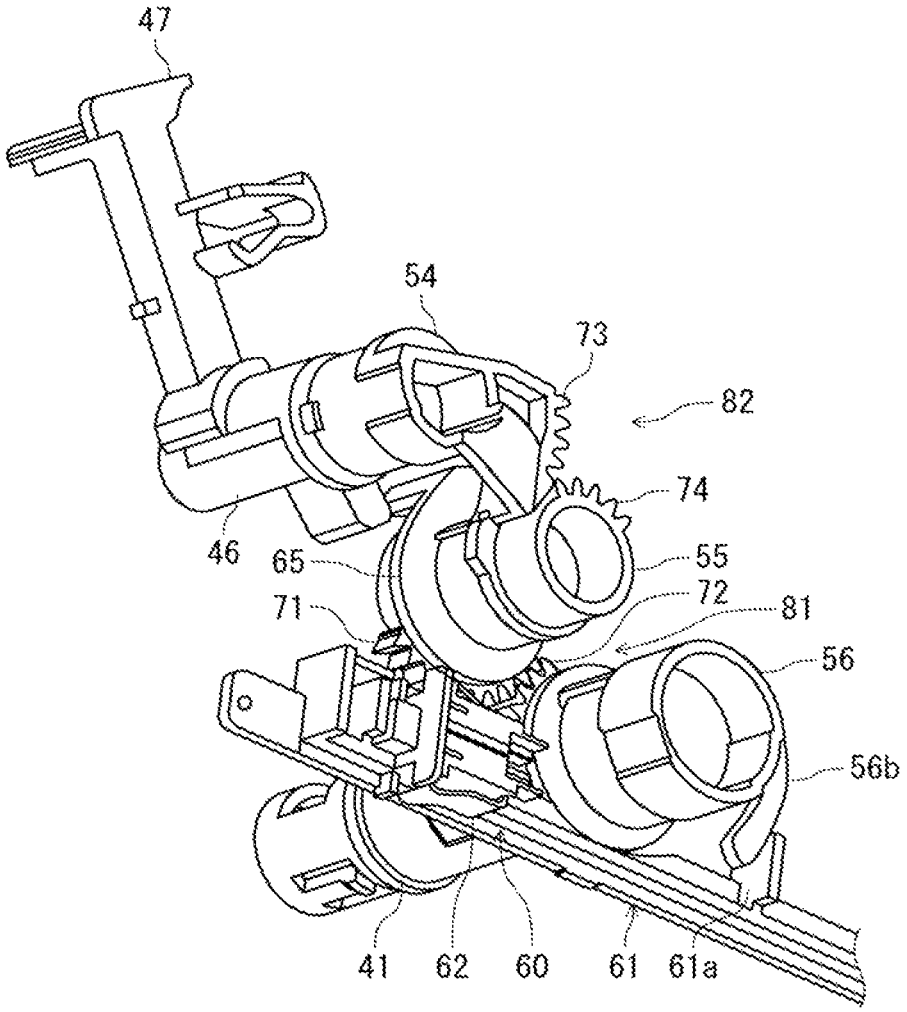
FIG. 14 is a perspective view showing first through third rotation portions coupled with first through third coupling portions.
Figure 15:
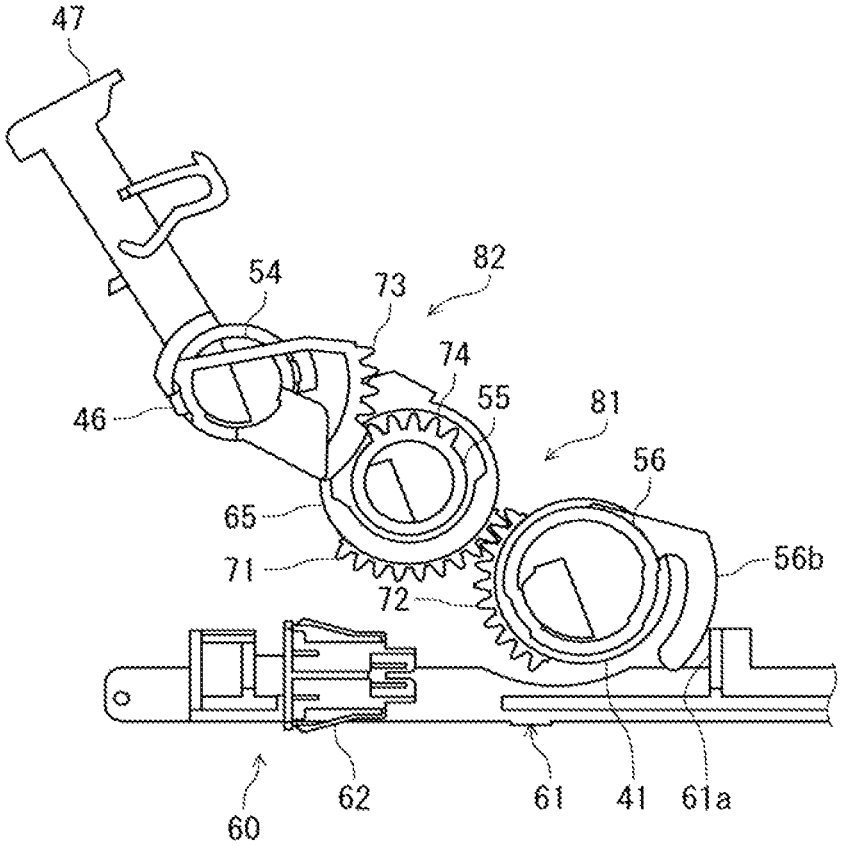
FIG. 15 is a front view showing first through third rotation portions coupled with first through third coupling portions.

Next, the attachment/detachment operation of the toner containers 30 to/from the apparatus main body 2 is explained. Here, FIGS. 14 and 15 show the first rotation portion 54, second rotation portion 55, and third rotation portion 56 coupled with the first coupling portion 57, second coupling portion 58, and third coupling portion 59.

Before the toner container 30 is attached to the apparatus main body 2, the toner discharge outlet 32 is closed by the shutter cylinder 41. Here, as shown in FIGS. 6 and 7, the first coupling portion 57, the first portion 58*a* of the second coupling portion 58, and the first portion 59*a* of the third coupling portion 59 respectively extend in the attachment direction in which the cover member 52 is guided by the container guide 19 (i.e., extend diagonally downward).

In addition, as shown in FIG. 11, before the toner container 30 is attached to the apparatus main body 2, the first coupling groove 54*a* of the first rotation portion 54, the second coupling groove 55*a* of the second rotation portion 55, and the third coupling groove 56*a* of the third rotation portion 56 extend in the direction in which the container guides 19 extend (i.e., the attachment direction in which the cover member 52 is guided).

When the toner container 30 is attached to the attachment portion 18, the cover member 52 is inserted into the container guide 19 of the attachment portion 18. The cover member 52 is then guided by the container guide 19 diagonally downward. Furthermore, as shown in FIG. 13, the first coupling portion 57 of the toner container 30 is guided by the first groove portion 19*a*, the second coupling portion 58 is guided by the second groove portion 19*b*, and the third coupling portion 59 is guided by the third groove portion 19*c*.

As a result, as shown in FIGS. 13 through 15, the first coupling portion 57 is coupled with the first coupling groove 54*a* of the first rotation portion 54, the second coupling portion 58 is coupled with the second coupling groove 55*a* of the second rotation portion 55, and the third coupling portion 59 is coupled with the third coupling groove 56*a* of the third rotation portion 56.

Next, the toner discharge outlet 32 is opened by swinging the lever 47 of the attachment portion 18. Here, FIGS. 16 through 19 show the state where the lever 47 has been swung.

Figure 16:
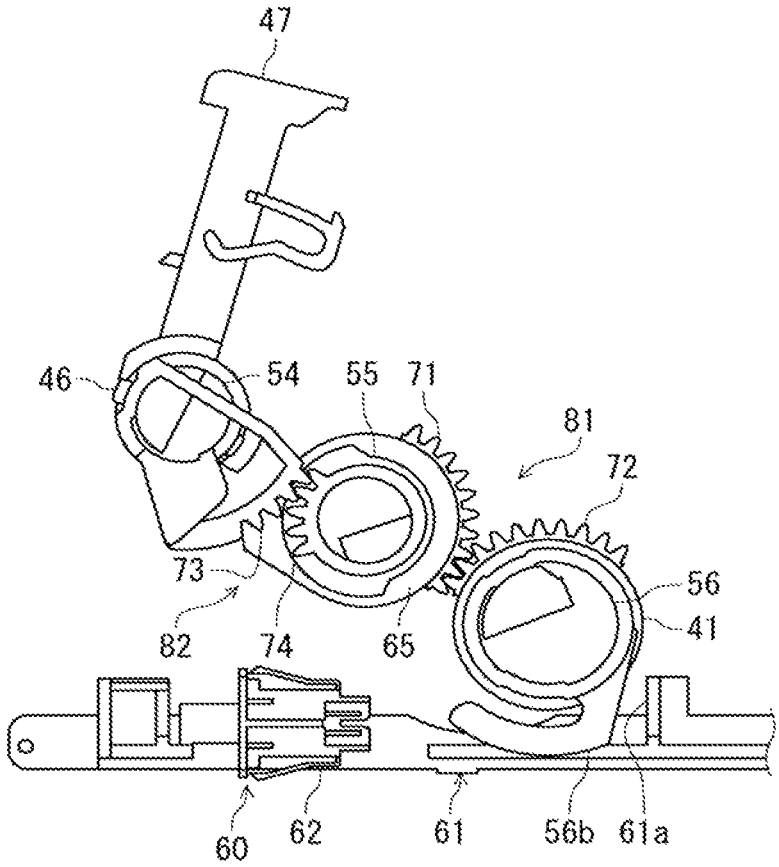
FIG. 16 is a front view showing the first through third rotation portions with the lever swung.
Figure 17:
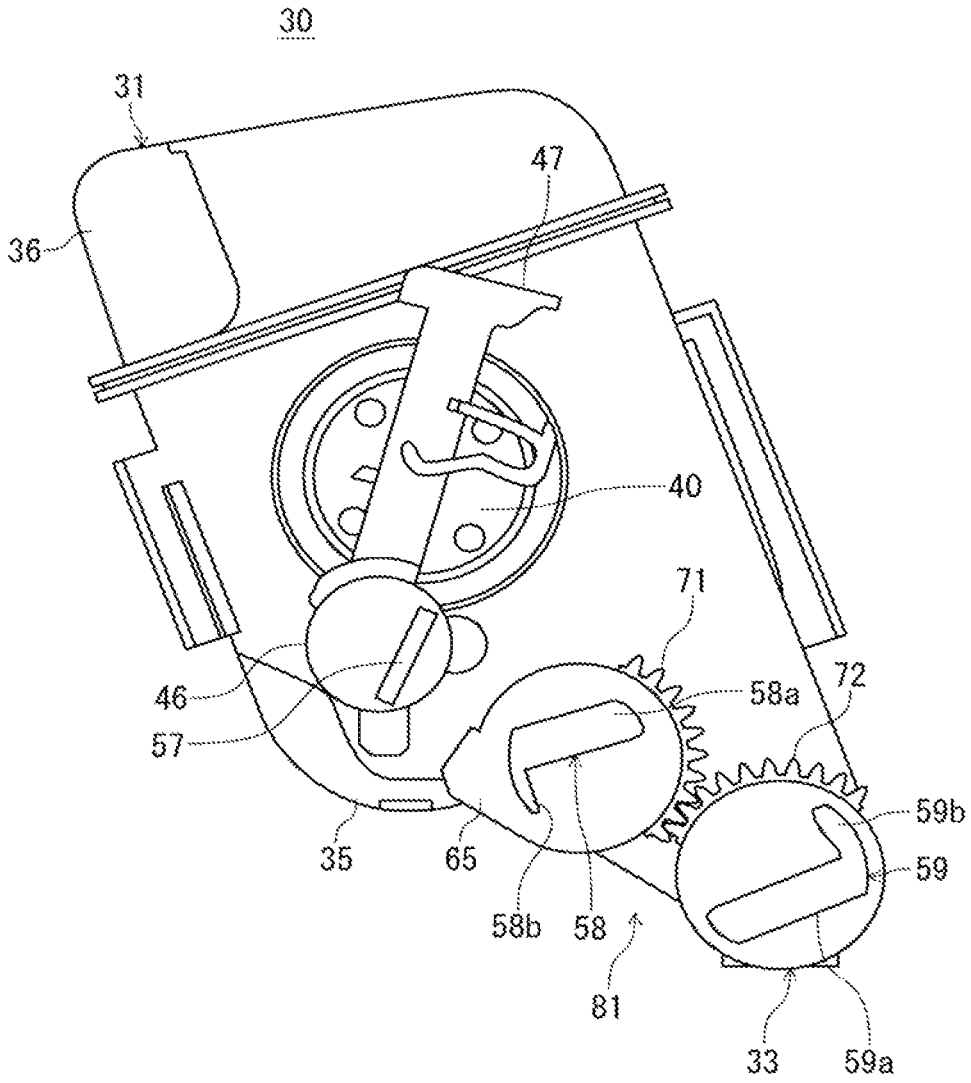
FIG. 17 is a front view showing the toner container with the lever swung.
Figure 18:
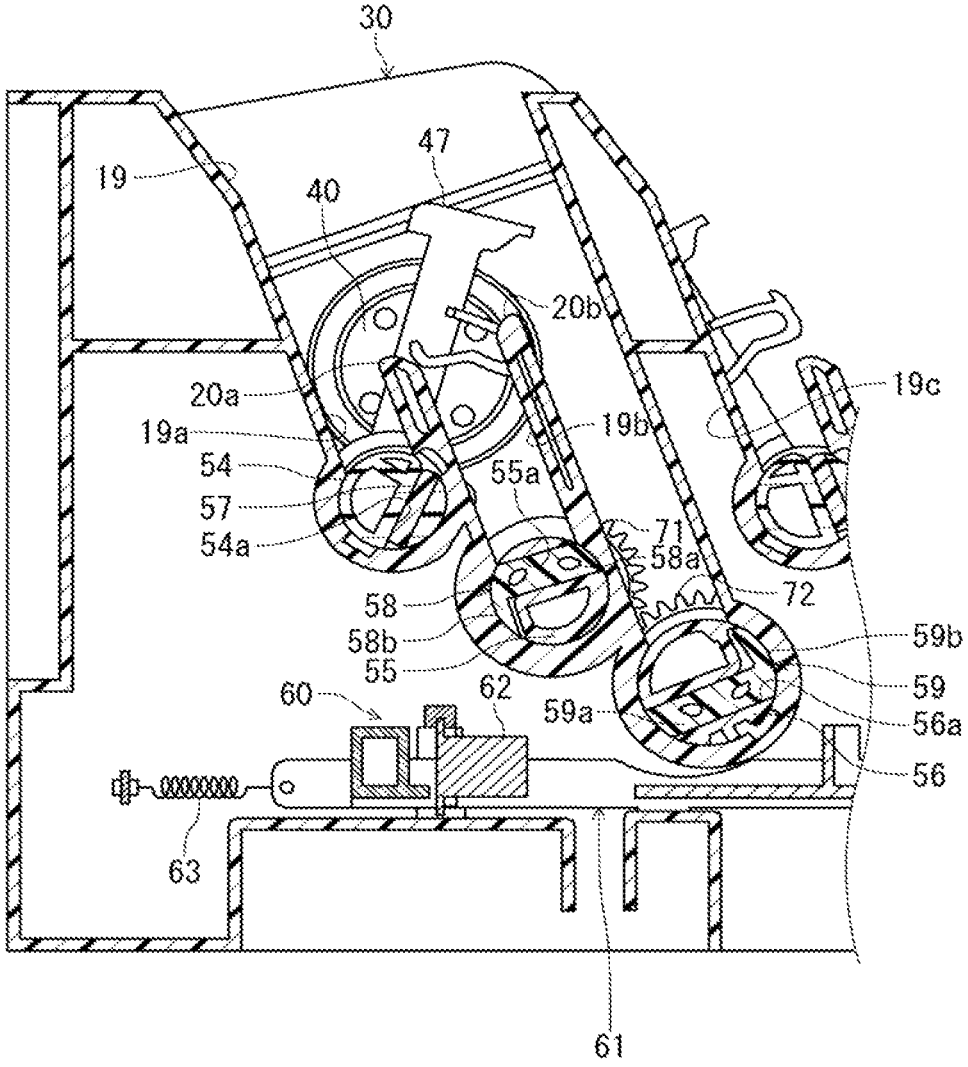
FIG. 18 is a partially broken front view showing the toner container after it is attached to the attachment portion and the lever is swung.

When the lever 47 is swung in the state where the toner container 30 has been attached to the attachment portion 18, the first coupling portion 57 is integrally rotated with the lever 47 clockwise as shown in FIGS. 16 through 18. Since the first coupling portion 57 is coupled with the first rotation portion 54, the first rotation portion 54 integrally rotates with the first coupling portion 57.

Here, the third gear 73, which integrally rotates with the first rotation portion 54, meshes with the fourth gear 74. In addition, the fourth gear 74 integrally rotates with the second rotation portion 55. Therefore, as the first coupling portion 57 rotates, the second coupling portion 58 rotates in the direction opposite to the rotational direction of the first coupling portion 57.

Furthermore, since the second coupling portion 58 is coupled with the second rotation portion 55, the second rotation portion 55 integrally rotates with the second coupling portion 58. Here, the first gear 71, which integrally rotates with the second coupling portion 58, meshes with the second gear 72. In addition, the second gear 72 integrally rotates with the third coupling portion 59.

Therefore, as the second coupling portion 58 rotates, the third coupling portion 59 rotates in the direction that is opposite to the rotational direction of the second coupling portion 58 (i.e., rotates in the same direction as the rotational direction of the first coupling portion 57). When the third coupling portion 59 rotates, the shutter cylinder 41 integrally with the third coupling portion 59.

As described above, swinging the lever 47 in the state where the toner container 30 has been attached to the apparatus main body 2 causes the shutter cylinder 41 to rotate, and the toner discharge outlet 32 is opened. And when all of the toner discharge outlets 32 are opened, the open state thereof is detected by the detection mechanism 60.

It is noted here that although the first, second, and third coupling portions are such portions that provide the non-compatible function of the toner containers 30, if the first, second, or third coupling portion is cut off, the rotation portion corresponding to the cut-off coupling portion cannot be rotated. In that case, the driving force of the lever is not transmitted to the third coupling portion, and it becomes impossible to exert the function of the toner container to allow for the opening/closing mechanism to operate so as to discharge the toner from the toner discharge outlet.

That is, according to the above-described configuration, if the first, second, or third coupling portion is cut off, it becomes impossible to exert the function of the toner container, and thus, with this configuration, it is possible to appropriately restrict a plurality of types of toner, which are different from the type of toner suitable for the image forming apparatus, from being used in the image forming apparatus.

Furthermore, by combining the shapes of the first through third coupling portions, it is possible to prepare a various number of shape patterns for the portion that provides the non-compatible function. Therefore, according to the present embodiment, it is possible to appropriately restrict a plurality of types of toner, which are different from the type of toner suitable for the image forming apparatus, from being used in the image forming apparatus.

Thus, according to the present embodiment, the first coupling portion 57 and the second coupling portion 58 allow for attachment of the toner containers 30 to the apparatus main body 2 of a predetermined model, while not allowing for attachment thereof to the apparatus main bodies of the other models. It is thus possible to cause the toner containers 30 to be used by the image forming apparatus 1 of the predetermined model.

It is noted here that although the first coupling portion 57, second coupling portion 58, and third coupling portion 59 are such portions that provide the non-compatible function of the toner containers 30, if any of the first coupling portion 57, second coupling portion 58, and third coupling portion 59 is cut off, any of the first rotation portion 54, second rotation portion 55, and third rotation portion 56 corresponding to the cut-off coupling portion cannot be rotated. In that case, the driving force of the lever 47 is not transmitted to the third coupling portion 59, and it becomes impossible to exert the function of the toner container 30 to allow for the opening/closing mechanism 33 to operate so as to discharge the toner from the toner discharge outlet 32.

That is, according to the present embodiment, if any of the first coupling portion 57, second coupling portion 58, and third coupling portion 59 is cut off, it becomes impossible to exert the function of the toner container 30, and thus, with this configuration, it is possible to appropriately restrict a plurality of types of toner, which are different from the type of toner suitable for the image forming apparatus 1, from being used in the image forming apparatus 1.

Furthermore, by combining the shapes of the first coupling portion 57, second coupling portion 58, and third coupling portion 59, it is possible to prepare a various number of shape patterns for the portion that provides the non-compatible function. Therefore, it is possible to more appropriately restrict a plurality of types of toner, which are different from the type of toner suitable for the image forming apparatus 1, from being used in the image forming apparatus 1.

Furthermore, before the toner container 30 is attached to the apparatus main body 2, even if the user swings the lever 47 by mistake, the driving force thereof is not transmitted from the first coupling portion 57 to the third coupling portion 59, and thus the toner discharge outlet 32 is not opened, and it is possible to prevent the toner from being leaked from the housing 31.

Furthermore, in the state where the first coupling groove 54*a*, second coupling groove 55*a*, and third coupling groove 56*a* are disposed parallel to each other, it is possible, by sliding and moving the toner container 30 in the groove length direction of the first coupling groove 54*a*, second coupling groove 55*a*, and third coupling groove 56*a*, for the first coupling portion 57, second coupling portion 58, and third coupling portion 59 of the toner containers 30 to be inserted and fitted in the first coupling groove 54*a*, second coupling groove 55*a*, and third coupling groove 56*a*, respectively. In such a manner, the toner containers 30 can be attached to the apparatus main body 2.

Furthermore, when the lever is swung, the first coupling portion 57, second coupling portion 58, and third coupling portion 59 are respectively rotated, and portions of the first coupling portion 57, second coupling portion 58, and third coupling portion 59, which extend linearly, are not disposed parallel to each other. This makes it possible to use the first coupling portion 57, second coupling portion 58, and third coupling portion 59 as a mechanism for preventing the toner containers 30 from being removed from the apparatus main body 2.

Here, when the third coupling portion 59 is appropriately coupled with the third rotation portion 56, the sensor 62 can detect that all of the third rotation portions 56 were rotated. This enables the detection mechanism 60 to detect the open state of the toner discharge outlet 32. However, if the third coupling portion 59 is removed, the third coupling portion 59 is not coupled with the third rotation portion 56, and thus the third rotation portion 56 is not rotated even if the lever 47 is swung. In that case, the detection mechanism 60 cannot detect the open state of the toner discharge outlet 32, and the image forming apparatus 1 may not be used appropriately. Thus, according to the present embodiment, it is possible to restrict the use of an inappropriate toner container 30 from which, for example, the third coupling portion 59 has been removed.

It is noted that the present embodiment provides a configuration where the second coupling portion 58 and the third coupling portion 59 are rotated in conjunction with each other by the first gear 71 and the second gear 72.

The present embodiment also provides a configuration where the first rotation portion 54 and the second rotation portion 55 are rotated in conjunction with each other by the third gear 73 and the fourth gear 74. However, not limited to these configurations, for example, a transmission belt or the like may be used for the second coupling portion 58 and the third coupling portion 59 to rotate in conjunction with each other, and/or for the first rotation portion 54 and the second rotation portion 55 to rotate in conjunction with each other.

In the present embodiment, an example case, where the image forming apparatus 1 includes three coupling portions 57, 58 and 59 and three rotation portions 54, 55 and 56, is explained. However, not limited to this configuration, a plurality of coupling portions and a plurality of rotation portions may be included.

That is, the apparatus main body 2 may include a plurality of rotation portions provided each rotatably in alignment with each other, and each of the toner containers 30 may include a plurality of coupling portions rotatably in correspondence with the plurality of rotation portions. In addition, the opening/closing mechanism may be configured to open and close the toner discharge outlet 32 when a coupling portion, which is disposed at the other end in the alignment direction of the coupling portions and the rotation portions, rotates.

In addition, the interlocking mechanism, which causes the adjacent coupling portions to rotate in conjunction with each other, and the interlocking mechanism, which causes the adjacent rotation portions to rotate in conjunction with each other, are disposed alternately (i.e., in zigzag) on the coupling portions side and on the rotation portions side, from one end to the other end in the alignment direction. This causes the driving force applied to the lever to be transmitted alternately (meanderingly) between the apparatus main body 2 and the toner container 30 from one end to the other end in the alignment direction.

Furthermore, in the present embodiment, an example case where the lever 47 is provided on the toner containers 30 that are the coupling portions side is explained. However, not limited to this configuration, the lever 47 may be configured to integrally swing with the rotation portion or the coupling portion that is disposed at one end in the alignment direction.

In the present embodiment, a laser printer is described as an example of the image forming apparatus 1. However, not limited to this, the image forming apparatus 1 of the present disclosure may be another image forming apparatus such as a copier, a scanner device, a multifunction peripheral, or the like.

As described above, the present disclosure is useful as a toner container and an image forming apparatus including thereof.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

an apparatus main body including a plurality of rotation portions provided each rotatably, in alignment with each other; and a toner container attached to the apparatus main body and including a housing for storing toner, a toner discharge outlet formed on the housing, an opening/closing mechanism provided on the housing and configured to open and close the toner discharge outlet, and a plurality of coupling portions that are provided each rotatably in correspondence with the plurality of rotation portions, wherein each of the plurality of coupling portions is configured to, when the toner container is attached to the apparatus main body, be coupled with a corresponding one of the plurality of rotation portions to be integrally and coaxially rotatable therewith, the image forming apparatus further comprising:

a lever configured to integrally swing with one of the plurality of rotation portions or one of the plurality of coupling portions that is disposed at one end in an alignment direction of the plurality of rotation portions and the plurality of coupling portions, wherein the opening/closing mechanism is configured to open and close the toner discharge outlet by opening and closing a shutter member as the one of the plurality of coupling portions, which is disposed at one end in the alignment direction, rotates, and a first interlocking mechanism, which causes adjacent coupling portions to rotate in conjunction with each other, and a second interlocking mechanism, which causes adjacent rotation portions to rotate in conjunction with each other, are disposed alternately on coupling portions side and on rotation portions side, from one end to the other end in the alignment direction.

2. The image forming apparatus according to claim 1, further comprising a detection mechanism including: a rotation portion disposed at the other end in the alignment direction; and a sensor capable of detecting rotation of the rotation portion, the detection mechanism detecting that the toner discharge outlet of the toner container attached to the apparatus main body is in an open state, based on a detection result of the sensor.

3. The image forming apparatus according to claim 1, wherein the plurality of rotation portions are a first rotation portion, a second rotation portion, and a third rotation portion that are provided in alignment from one end to the other end in the alignment direction, the plurality of coupling portions are a first coupling portion, a second coupling portion, and a third coupling portion that are provided in alignment from one end to the other end in the alignment direction, the lever is configured to be integrally swung with the first coupling portion, the opening/closing mechanism is configured to open and close the toner discharge outlet as the third coupling portion rotates, the first rotation portion and the second rotation portion are configured to be rotated in conjunction with each other by the second interlocking mechanism, and the second coupling portion and the third coupling portion are configured to be rotated in conjunction with each other by the first interlocking mechanism.

4. The image forming apparatus according to claim 3, wherein the first rotation portion includes a first coupling groove extending linearly at least in part, the second rotation portion includes a second coupling groove extending linearly at least in part, the third second rotation portion includes a third coupling groove extending linearly at least in part, the first coupling portion has a shape of a projection so as to be fitted in the first coupling groove of the first rotation portion, the second coupling portion has a shape of a projection so as to be fitted in the second coupling groove of the second rotation portion, and the third coupling portion has a shape of a projection so as to be fitted in the third coupling groove of the third rotation portion.

5. The image forming apparatus according to claim 1, wherein the toner container includes:

a stirring paddle configured to stir the toner in the housing; and a screw portion configured to convey the toner in the housing to the toner discharge outlet, wherein a gear portion that transmits a driving force to the stirring paddle and the screw portion is disposed at an end that is opposite to the one of the plurality of coupling portions in a longitudinal direction of the stirring paddle and the screw portion.

6. A toner container comprising:

a housing attached to an apparatus main body and configured to store toner, the apparatus main body including a plurality of rotation portions provided each rotatably, in alignment with each other;

a toner discharge outlet formed on the housing;

an opening/closing mechanism provided on the housing and configured to open and close the toner discharge outlet; and a plurality of coupling portions that are provided each rotatably in correspondence with the plurality of rotation portions, wherein each of the plurality of coupling portions is configured to, when the toner container is attached to the apparatus main body, be coupled with a corresponding one of the plurality of rotation portions to be integrally and coaxially rotatable therewith, one of the plurality of rotation portions or one of the plurality of coupling portions that is disposed at one end in an alignment direction of the plurality of rotation portions and the plurality of coupling portions includes a lever configured to integrally swing with the one of the plurality of rotation portions or the one of the plurality of coupling portions, the opening/closing mechanism is configured to open and close the toner discharge outlet by opening and closing a shutter member as the one of the plurality of coupling portions, which is disposed at one end in the alignment direction, rotates, and a first interlocking mechanism, which causes adjacent coupling portions to rotate in conjunction with each other, and a second interlocking mechanism, which causes adjacent rotation portions to rotate in conjunction with each other, are disposed alternately on coupling portions side and on rotation portions side, from one end to the other end in the alignment direction.

7. The toner container according to claim 6, wherein the plurality of rotation portions are a first rotation portion, a second rotation portion, and a third rotation portion that are provided in alignment from one end to the other end in the alignment direction, the plurality of coupling portions are a first coupling portion, a second coupling portion, and a third coupling portion that are provided in alignment from one end to the other end in the alignment direction, the lever is configured to be integrally swung with the first coupling portion, the opening/closing mechanism is configured to open and close the toner discharge outlet as the third coupling portion rotates, the first rotation portion and the second rotation portion are configured to be rotated in conjunction with each other by the second interlocking mechanism, and the second coupling portion and the third coupling portion are configured to be rotated in conjunction with each other by the first interlocking mechanism.

8. The toner container according to claim 7, wherein the first rotation portion includes a first coupling groove extending linearly at least in part, the second rotation portion includes a second coupling groove extending linearly at least in part, the third second rotation portion includes a third coupling groove extending linearly at least in part, the first coupling portion has a shape of a projection so as to be fitted in the first coupling groove of the first rotation portion, the second coupling portion has a shape of a projection so as to be fitted in the second coupling groove of the second rotation portion, and the third coupling portion has a shape of a projection so as to be fitted in the third coupling groove of the third rotation portion.

9. The toner container according to claim 6 further comprising:

a stirring paddle configured to stir the toner in the housing; and a screw portion configured to convey the toner in the housing to the toner discharge outlet, wherein a gear portion that transmits a driving force to the stirring paddle and the screw portion is disposed at an end that is opposite to the one of the plurality of coupling portions in a longitudinal direction of the stirring paddle and the screw portion.

* * * * *